US007425054B2

(12) United States Patent
Li

(10) Patent No.: US 7,425,054 B2
(45) Date of Patent: Sep. 16, 2008

(54) REDUCED MEMORY USAGE FOR DELAY BUFFER DURING PRINTING SWATHS IN AN INKJET PRINTER

(75) Inventor: Chingwen Li, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 177 days.

(21) Appl. No.: 11/422,953

(22) Filed: Jun. 8, 2006

(65) Prior Publication Data

US 2007/0285445 A1 Dec. 13, 2007

(51) Int. Cl.
*B41J 2/21* (2006.01)

(52) U.S. Cl. ..... 347/43; 347/40; 347/41

(58) Field of Classification Search ..... 347/40, 347/41, 42, 43; 395/109

See application file for complete search history.

(56) References Cited

U.S. PATENT DOCUMENTS 5,574,832 A * 11/1996 Towery et al. ..... 358/1.9
6,039,434 A * 3/2000 Moroney ..... 347/43
6,154,233 A * 11/2000 Breswick ..... 347/40

* cited by examiner

*Primary Examiner*—Lam S Nguyen

(57) ABSTRACT

Disclosed is a method for printing swaths of an image in an inkjet printer with reduced memory usage for delay buffer. The present invention provides methods for allocating a memory space of M1, and M2, for the delay buffer, where M1 equals N*S*(P+1)/2, and M2 equals N*S*(P−1)/2, wherein N is the number of nozzles in a color bank of a printhead, S is the horizontal swath resolution and P is the minimum number of pass required to print the image. The proposed methods lower the hardware requirement of the physical memory by saving up to about 50% of the physical memory by implementing a memory space of M1 and more than 50% of physical memory may be saved by implementing a memory space of M2.

20 Claims, 7 Drawing Sheets

REDUCED MEMORY USAGE FOR DELAY BUFFER DURING PRINTING SWATHS IN AN INKJET PRINTER

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present disclosure relates generally to imaging systems, and, more particularly, to a method for printing swaths of an image in an inkjet printer with reduced memory usage for delay buffer.

2. Description of the Related Art

Inkjet printers have gained wide popularity in businesses and homes because of their low cost, high print quality and additionally, color printing capability. Inkjet printers typically print an image by ejecting droplets of ink on a print media from one or more vertical columns of nozzles disposed on a printhead. As the printhead scans across the print media, the droplets are ejected to form a matrix of dots. For each dot, which makes up the image, there is image data describing which nozzle is to print the dot during a particular pass and describing the horizontal position on the page at which to print the dot.

After a print command is issued, the printer driver sends image data in the form of consecutive raster lines to a formatter. The formatter allocates a memory to store the raster data before there are enough data to build a swath. The allocated memory is called a delay buffer. The amount of raster data to be stored on the delay buffer depends on the number of nozzles in a color bank of the printhead, print resolution (number of dots per inch), and the width of the print media.

For 2400×1200 dpi data to be printed, each color bank has 320 nozzles, the horizontal resolution is 2400 dpi and the vertical resolution is 1200 dpi, the allocated memory provides storage for all the data to be printed under a full printhead, i.e., memory (M)=number of nozzles*vertical resolution multiplier*horizontal resolution=320*2*2400=1,536,000 bytes. The vertical resolution multiplier is equal to 2 if the nozzle resolution is 600 nozzles per inch. The full head covers twice as many raster lines as its nozzles. More memory is needed if there are more nozzles on the head or if the printing resolution is higher. The printhead does not print all the data in one pass except when printing in low resolution. When the printhead fires ink dots at 1200 dpi rate (S), the color head needs a minimum of 4 passes (P) to advance paper for a full head size (overall length of the printhead), in order to print 2400×1200 dpi data. Because S*P=vertical resolution multiplier*horizontal resolution, we can rewrite the equation as: M=N*S*P (Equation 1), where M: Memory size, N: number of nozzles in a color bank, S: number of slices per inch in a swath (swath resolution), and P: number of passes to advance paper for a full head size. The amount of memory calculated from the equation M=N*S*P is M=320*1200*4=1,536,000 bytes.

The formatter breaks the image data, i.e., raster lines into its component color lines. For example, a raster line with a format of CMYK is broken into 4 individual color lines, cyan, magenta, yellow and black. A color line may have 600, 1200, 2400, or 4800 dots per inch. Because a printhead fires ink dots at the optimal nozzle firing speed, a nozzle may fire a subset of ink dots in a color line. A color line is further split into color layers. Referring to FIGS. 1A and 1B (PRIOR ART), if a nozzle fires at speed of 1200 dots per inch, the color line of 2400 dpi is split into two color layers of 1200 dpi. One color layer contains odd dots and the other contains even dots. Two color layers are stored in two separate segments of the delay buffer. A nozzle is able to fire all the ink dots in a color layer in one pass, and 4 passes (Pass I, Pass II, Pass III, and Pass IV) are needed to advance paper for a full head size. Each pass prints a swath that is built with color layers in a segment (see FIG. 1A). Pass I prints ink dots on odd rows and odd columns. Pass II prints ink dots on even rows and odd columns. Pass III prints ink dots on odd rows and even columns. Pass IV prints ink dots on even rows and even columns. Since the resolution of the image to be printed is generally higher than the swath resolution, the image data, i.e., the raster lines, are split into color layers that have the same horizontal resolution as the swath. Accordingly, the buffer is divided into two segments, namely, segment 1 and segment 2. Segment 1 stores color layers for pass I and Pass II. Segment 2 stores color layers for pass III and pass IV (see FIG. 1B).

When the formatter has accumulated enough color layers, a swath is built. For a printhead with 320 nozzles to print a resolution of 2400×1200 dpi in 4 passes, the print media is advanced by one-fourth of full (vertical) head size in each pass of 80/600 inch for the print. The segments storing the color layers have a queue structure. At the top of a page, the first 160 layers are added to each segment. The color layers are then stored on the bottom ¼ of a segment. The formatter advances the print media by one-fourth of the full head size. The first swath is built with 80 odd color layers in segment 1. The swath is printed using 80 nozzles starting from a bottom of the printhead. After the first swath is built, the formatter adds 160 more color layers to each segment in order to build a second swath. The formatter moves paper by another one-fourth of the full head size. The second swath is built with 160 even color layers in segment 1 using 160 nozzles starting from the bottom of the printhead. Then, the formatter adds another 160 color layers to each segment, and advances the print media by another one-fourth of the full head size. The third swath is built with 240 odd color layers in segment 2 using 240 nozzles starting from the bottom of the printhead. Then, the formatter adds another 160 color layers to each segment, and advances the print media by another one-fourth of the full head size. The fourth swath is built with 320 even color layers in segment 2 using all the 320 nozzles of the printhead. At this point the bottom one quarter of each segment is empty and available for reuse. Then, the formatter adds another 160 color layers to each segment, and advances the print media by another one-fourth of the full head size. Thereafter, a fifth swath may be built using 320 odd color layers in segment 1. The above process of storing the color layers in segments and building a swath is repeated until the printer driver stops sending the raster lines.

With the above approach, the amount of memory needed to allocate in a delay buffer may considerably increase with higher printing resolution and number of nozzles in the printhead. If the formatter is host based, the higher memory requirement of the above approach can be a performance issue for computers with small physical memory.

None of the conventional approaches used for allocating the memory needed to store the image data have successfully addressed the problem of higher memory requirement in inkjet printers. Accordingly, what is needed in an approach for reduced memory usage for delay buffer during printing swaths in an inkjet printer.

SUMMARY OF THE INVENTION

The general purpose of the present disclosure is to provide a method for printing swaths of an image in an inkjet printer with reduced memory usage for delay buffers.

In one aspect, the present disclosure provides a method of printing swaths of an image. The method comprises: (a) calculating a minimum number of passes, P, required to print the image using the equation $P=(H_i*V_i)/(H_s*V_s)$, wherein, $H_i$ equals horizontal resolution of the image, $V_i$ equals vertical resolution of the image, $H_s$ equals horizontal resolution of the swath, and $V_s$ equals vertical resolution of the swath; (b) allocating a memory space equal to N*S*(P+1)/2 for a delay buffer, wherein N equals number of nozzles in a color bank and S equals swath resolution; (c) dividing the delay buffer into g segments having a first segment, a second segment, a $(g-1)^{th}$ segment, and a $g^{th}$ segment, wherein g=P(P+1)/2, such that, size of each of g segment equals (N/P)*S; (d) receiving (N/P)*D raster lines and splitting the raster lines into P color layers having a first color layer for a first pass, a second color layer for a second pass, a $(P-1)^{th}$ color layer for a $(P-1)^{th}$ pass, and a $P^{th}$ color layer for a $P^{th}$ pass, wherein D equals $V_i/V_s$; (e) searching for empty segments from g segments of the delay buffer and grouping the empty segments into a first empty segment, a second empty segment, a $(P-1)^{th}$ empty segment, and a $P^{th}$ empty segment; (f) storing the first color layer for the first pass in the first empty segment, the second color layer for the second pass in the second empty segment, the $(P-1)^{th}$ color layer for the $(P-1)^{th}$ pass in $(P-1)^{th}$ empty segment, and the $P^{th}$ color layer for the $P^{th}$ pass in the $P^{th}$ empty segment; (g) building an $i^{th}$ swath using segments having color layers for $i^{th}$ pass, and printing the $i^{th}$ swath, wherein, i equals 1, 2, . . . P, (h) emptying the segments having the color layers for the $i^{th}$ pass; (i) advancing the print media and checking for incoming raster lines; and (j) repeating steps (d) to (i) upon determining the incoming raster lines.

In another aspect, the present disclosure provides a method of printing swaths of an image. The method comprises (a) calculating a minimum number of passes P, required to print the image using the equation $P=(H_i*V_i)/(H_s*V_s)$, wherein, $H_i$ equals horizontal resolution of the image, $V_i$ equals vertical resolution of the image, $H_s$ equals horizontal resolution of the swath, and $V_s$ equals vertical resolution of the swath; (b) allocating a memory space equal to N*S*(P−1)/2 for a delay buffer, wherein N equals number of nozzles in a color bank and S equals swath resolution; (c) dividing the delay buffer into g segments having a first segment, a second segment, a $(g-1)^{th}$ segment, and a $g^{th}$ segment, wherein g=P(P−1)/2, such that, size of each of g segment equals (N/P)*S; (d) receiving 8*D incoming raster lines and splitting the raster lines into P color layers having a first color layer for a first pass, a second color layer for a second pass, a $(P-1)^{th}$ color layer for a $(P-1)^{th}$ pass, and a $P^{th}$ color layer for a $P^{th}$ pass; (e) searching for empty segments from g segments of the delay buffer and grouping the empty segments into a first empty segment, a second empty segment, and a $(P-1)^{th}$ empty segment, and storing P−1 color layers in the empty segments without storing the color layers for $i^{th}$ pass, wherein i equals 1, 2, . . . P; (f) converting the $i^{th}$ color layers of the incoming raster lines into partial swath for the $i^{th}$ pass; (g) repeating steps (d), (e) and (f) for (N/P)/8 times until a full swath is built for the $i^{th}$ pass, and printing the full swath; (h) building a next partial swath using segments having color layers for $(i+1)^{th}$ pass; (i) emptying the segment having the color layers for the $(i+1)^{th}$ pass; (j) advancing a print media and checking for incoming raster lines; and (k) repeating steps (d) to (j) upon determining the incoming raster lines.

In yet another aspect, the present disclosure provides an inkjet printer comprising: a printhead having a plurality of nozzles arranged in at least one vertical column, wherein the nozzle is capable of selectively ejecting droplets of ink on a print media to form swaths of an image; a printhead carrier capable of mounting and carrying the printhead; a carrier drive unit enabling the movement of the printhead carrier across the print media; a feed roller unit capable of advancing the print media during imaging; and a controller communicatively coupled to the printhead, the printhead carrier, the carrier drive unit and the feed roller unit, the controller having programmable instructions for performing a method. The method comprises (a) calculating a minimum number of passes P, required to print the image using the equation $P=(H_i*V_i)/(H_s*V_s)$, wherein, $H_i$ equals horizontal resolution of the image, $V_i$ equals vertical resolution of the image, $H_s$ equals horizontal resolution of the swath, and $V_s$ equals vertical resolution of the swath; (b) allocating a memory space equal to N*S*(P+1)/2 for a delay buffer, wherein N equals number of nozzles in a color bank and S equals swath resolution; (c) dividing the delay buffer into g segments having a first segment, a second segment, a $(g-1)^{th}$ segment, and a $g^{th}$ segment, wherein g=P(P+1)/2, such that, size of each of g segment equals (N/P)*S; (d) receiving (N/P)*D raster lines and splitting the raster lines into P color layers having a first color layer for a first pass, a second color layer for a second pass, a $(P-1)^{th}$ color layer for a $(P-1)^{th}$ pass, and a $P^{th}$ color layer for a $P^{th}$ pass, wherein D equals $V_i/V_s$, (e) searching for empty segments from g segments of the delay buffer and grouping the empty segments into a first empty segment, a second empty segment, a $(P-1)^{th}$ empty segment, and a $P^{th}$ empty segment; (f) storing the first color layer for the first pass in the first empty segment, the second color layer for the second pass in the second empty segment, the $(P-1)^{th}$ color layer for the $(P-1)^{th}$ pass in $(P-1)^{th}$ empty segment, and the $P^{th}$ color layer for the $P^{th}$ pass in the $P^{th}$ empty segment; (g) building an $i^{th}$ swath using segments having color layers for $i^{th}$ pass, and printing the $i^{th}$ swath, wherein, i equals 1, 2, P; (h) emptying the segments having the color layers for the $i^{th}$ pass; (i) advancing the print media and checking for incoming raster lines; and (j) repeating steps (d) to (i) upon determining the incoming raster lines.

In yet another aspect, the present disclosure provides an inkjet printer comprising: a printhead having a plurality of nozzles arranged in at least one vertical column, wherein the nozzle is capable of selectively ejecting droplets of ink on a print media to form swaths of an image; a printhead carrier capable of mounting and carrying the printhead; a carrier drive unit enabling the movement of the printhead carrier across the print media; a feed roller until capable of advancing the print media during imaging; and a controller communicatively coupled to the printhead, the printhead carrier, the carrier drive unit and the feed roller unit, the controller having programmable instructions for performing a method. The method comprises (a) calculating a minimum number of passes P, required to print the image using the equation $P=(H_i*V_i)/(H_s*V_s)$, wherein, $H_i$ equals horizontal resolution of the image, $V_i$ equals vertical resolution of the image, $H_s$ equals horizontal resolution of the swath, and $V_s$ equals vertical resolution of the swath; (b) allocating a memory space equal to N*S*(P−1)/2 for a delay buffer, wherein N equals number of nozzles in a color bank and S equals swath resolution; (c) dividing the delay buffer into g segments having a first segment, a second segment, a $(g-1)^{th}$ segment, and a $g^{th}$ segment, wherein g=P(P−1)/2, such that, size of each of g segment equals (N/P)*S; (d) receiving 8*D incoming raster lines and splitting the raster lines into P color layers having a first color layer for a first pass, a second color layer for a second pass, a $(P-1)^{th}$ color layer for a $(P-1)^{th}$ pass, and a $P^{th}$ color layer for a $P^{th}$ pass; (e) searching for empty segments from g segments of the delay buffer and grouping the empty segments into a first empty segment, a second empty segment, and a $(P-1)^{th}$ empty segment, storing P−1 color layers in the empty segments without storing the color layers for $i^{th}$ pass, wherein i equals 1, 2, P; (f) converting the $i^{th}$ color layers of the incoming raster lines into partial swath for the $i^{th}$ pass; (g) repeating steps (d), (e) and (f) for (N/P)/8 times until a full swath is built for the $i^{th}$ pass, and printing the full swath; (h) building a next partial swath using segments having color layers for $(i+1)^{th}$ pass; (i) emptying the segment having the color layers for the $(i+1)^{th}$ pass; (j) advancing a print media and checking for incoming raster lines; and (k) repeated steps (d) to (j) upon determining the incoming raster lines.

These together with other aspects of the present disclosure, along with the various features of novelty that characterize the disclosure, are pointed out with particularity in the claims annexed hereto and forming a part of this disclosure. For a better understanding of the present disclosure and the specific aspect attained by its uses, reference should be made to the accompanying drawings and descriptive matter in which, there are illustrated exemplary embodiments of the present disclosure.

BRIEF DESCRIPTION OF THE DRAWINGS

The above-mentioned and the other features and advantages of the present disclosure, and the manner of attaining them, will become more apparent, and will be better understood by reference to the following description of embodiments of the present disclosure taken in conjunction with the accompanying drawings, wherein.

Like reference numerals refer to like parts throughout several views of the drawings of the present disclosure.

DETAILED DESCRIPTION

Figure 1A:
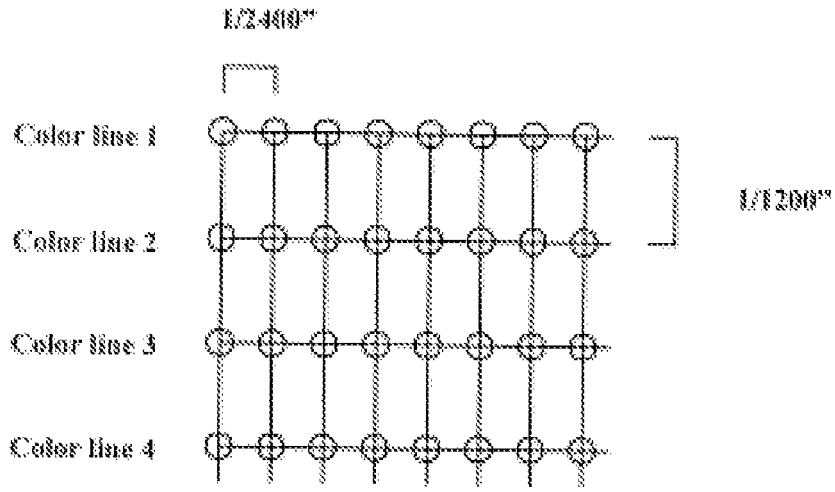
FIG. 1A (PRIOR ART)
FIG. 1A is a prior art diagram illustrating the color layer segmentation.
Figure 1B:
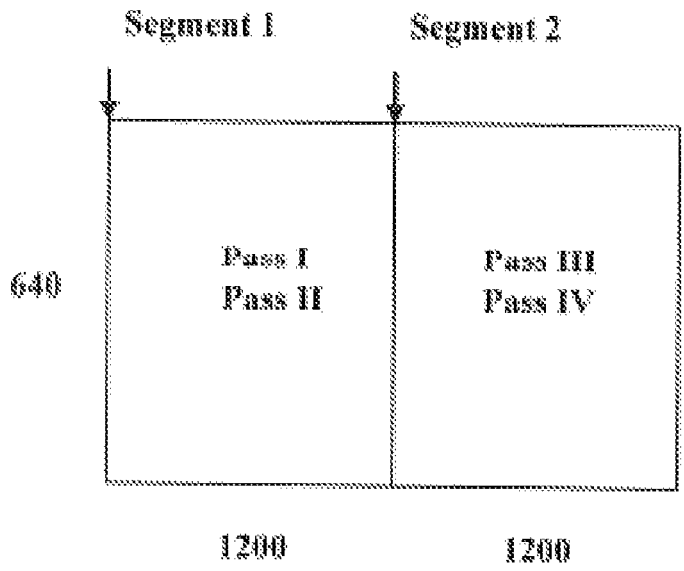
FIG. 1B (PRIOR ART)
FIG. 1B is a prior art diagram illustrating the segmentation of color layer buffer.

It is to be understood that the present disclosure is not limited in its application to the details of the methods, the construction and the arrangement of components set forth in the following description or illustrated in the drawings. The present disclosure is capable of having other embodiments and being practiced or being carried out in various ways. Also, it is to be understood that the phraseology and terminology used herein is for the purpose of description and should not be regarded as limiting. The use of "including," "comprising," or "having" and variations thereof, herein, is meant to encompass the items listed thereafter, and equivalents thereof, as well as additional items.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the present disclosure may be implemented in software. As such, it should be noted that a plurality of hardware and software-based devices as well as a plurality of different structural components may be utilized to implement the present disclosure. Furthermore, and as described in subsequent paragraphs, the specific components illustrated in the drawings are intended to exemplify embodiments of the present disclosure and that other alternative configurations of the components are also possible.

As used herein, the terms "first," "second," and so forth, herein do not denote any order, quantity, or importance, but rather are used to distinguish one element from another, and, the terms "a" and "an" do not denote a limitation of quantity, but rather denote the presence of at least one of the referenced item.

The present disclosure provides methods for printing swaths with reduced memory usage for delay buffer. The proposed methods of the present disclosure address the problem of higher memory requirement in inkjet printers. Using the methods proposed by the present disclosure, an amount of up to about 50 percent or more than 50 percent of memory space is saved in inkjet printers, thereby, lowering the hardware requirement for physical memory, and in turn, reducing the cost associated with the memory space of the physical memory.

Figure 2:
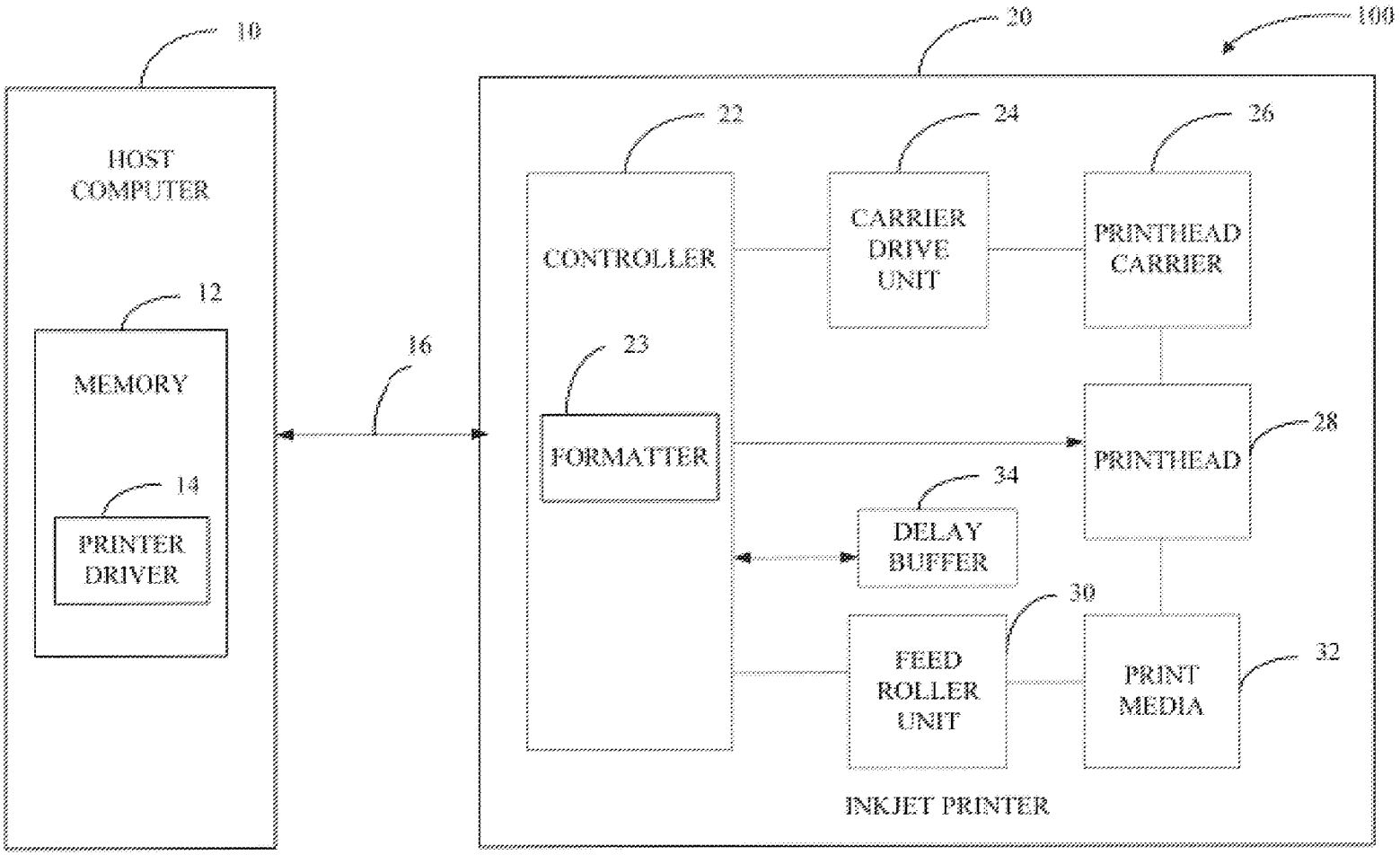
FIG. 2 is a block diagram of an imaging system 100, according to an exemplary embodiment of the present disclosure.

Referring to FIG. 2, a block diagram of an imaging system 100 is shown. The imaging system 100 comprises a host computer 10 and an inkjet printer 20. The host computer 10 may take form of a personal computer comprising a display device, for example, monitor (not shown), an input device, for example, keyboard (not shown), a processor (not shown), input/output interfaces (not shown), memory 12, such as, RAM, ROM, NVRAM, and the like, and a data storage device (not shown), such as, hard drive, floppy disks, compact disks, and the like. The memory 12 includes a printer driver 14 in the form of programmable instructions.

The inkjet printer 20 includes a controller 22, a carrier drive unit 24, a printhead carrier 26, a printhead 28, and a feed roller unit 30. The inkjet printer 20 further comprises a media source configured to receive a plurality of media from which an individual print media 32 is selected by sheet selection mechanism and transported to the feed roller unit 30. The feed roller unit 30, in turn, transports the print media 32 during the imaging operation through the printing zone. Suitable print media 32 includes, but is not limited to, plain paper, coated paper, photo paper, and transparency media. In one embodiment, the inkjet printer 20 may be configured for printing on both sides (duplex imaging) of the print media 32, without user intervention.

The controller 22 includes a microprocessor configured to execute programmable instructions to cause the printing of the image on the print media 32. The controller 22 coordinates with the printer driver 14 of the host computer 10 via communication link 16. The communication link 16 may be a direct electrical connection, or a wired or wireless network connection (e.g. LAN). In a network environment, communication between the host computer 10 and the inkjet printer 20 may be facilitated using a standard communication protocol, such as the Network Printer Alliance Protocol. The controller 22 is communicatively coupled to the carrier drive unit 24, the printhead carrier 26, the printhead 28 and the feed roller unit 30.

The printhead carrier 26 is capable of mounting and carrying one or more printheads 28. The printhead 28 includes a plurality of nozzles arranged in one or more vertical columns in a nozzle plate. The nozzles are capable of selectively ejecting droplets of ink on the print media 32, when corresponding heating elements disposed below the nozzle plate are activated by the controller 22. Each nozzle in the printhead 28 is individually activated to deposit a colored dot on the print media 32 as the printhead 28 scans horizontally across the print media 32. In one embodiment, the printhead 28 may include nozzles capable of depositing dots of cyan, magenta, yellow and black ink in a combination such that at least colors like black, blue, red, green, magenta, cyan, yellow, and white are produced.

The carrier drive unit 24 includes driving mechanism such as carrier motor, a carrier belt, an idler pulley, and the like. The driving mechanism enables the movement of the printhead carrier 26 and in turn printhead 28 across the print media 32. This horizontal movement across the print media 32 is referred to as scan or pass of the printhead 28.

Several adjacent rows of pixels printed by the nozzles as the printhead 28 makes a pass across the print media 32 covering the area required to print the image is referred to as a swath of the image. A full swath is printed when all the nozzles are activated during a pass. A partial swath is printed when only a portion of the nozzles are activated during a pass.

When the user of the host computer 10 issues a command for printing an image on the print media 32, the printer driver 14 residing on the memory 12 of the host computer 10 rasterizes image data of the image by dividing the image data into a plurality of horizontal rows of pixels. Each horizontal row of pixels corresponds to a raster line (color line). The printer driver 14 sends the image data in the form of consecutive raster lines to a program module (hereinafter, referred to as formatter 23) residing on the controller 22. Such raster lines being sent by the printer driver 14 are hereinafter referred to as incoming raster lines. The formatter 23 is responsible for generating a swath data based on the image data transferred from the host computer 10. The formatter 23 reorders the image data into consecutive vertical slices of pixels, wherein, each slice corresponds to the vertical column of nozzles on the printhead 28. The full swath is the combination of all the full slices across the width of the print media 32 required to print the desired image. The formatter 23 estimates the amount of memory needed to be allocated for storing the swath data, and thereafter, writes the swath data in a delay buffer 34. The swath data resides in the delay buffer 34 until it is sent by the controller 22 to the printhead 28 for imaging. During multi-pass printing, a swath may be printed using multiple printing passes, wherein, each print pass uses a full printhead size (entire length of the printhead) for high quality printing. In such cases, the print media 32 is advanced a corresponding fraction of the full printhead size after each print pass.

Figure 3:
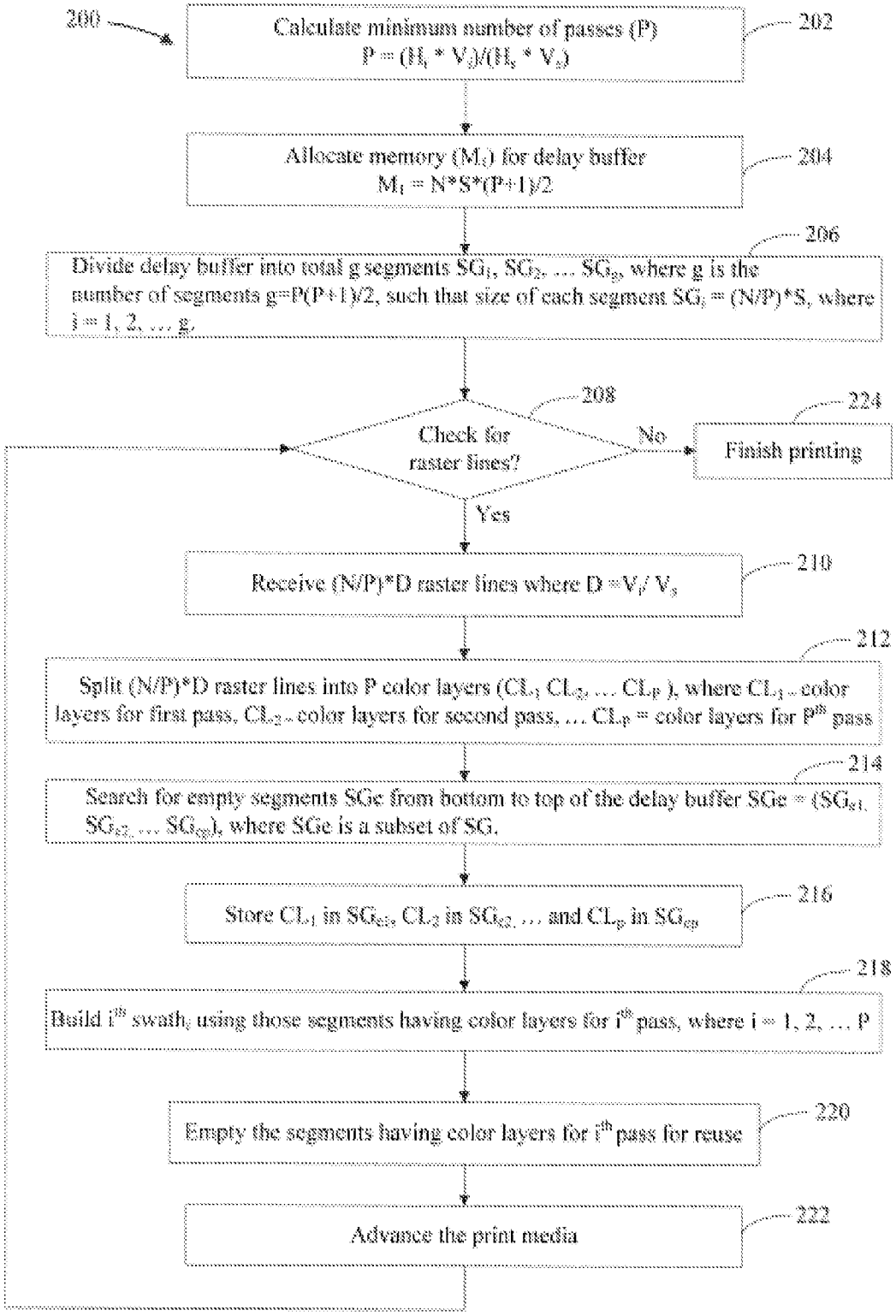
FIG. 3 is a flowchart illustrating a method for printing swaths with reduced memory usage for the delay buffer, according to an exemplary embodiment of the present invention.
Figure 4A:
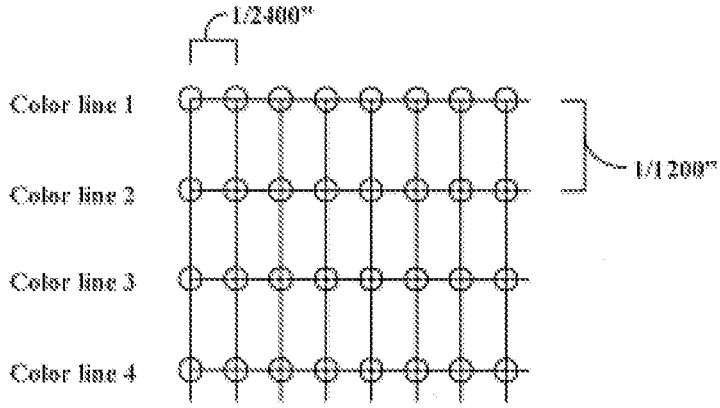
FIG. 4A illustrates color layer segmentation for a printing resolution of 2400×1200 dpi, according to an exemplary embodiment of the present invention.
Figure 4B:
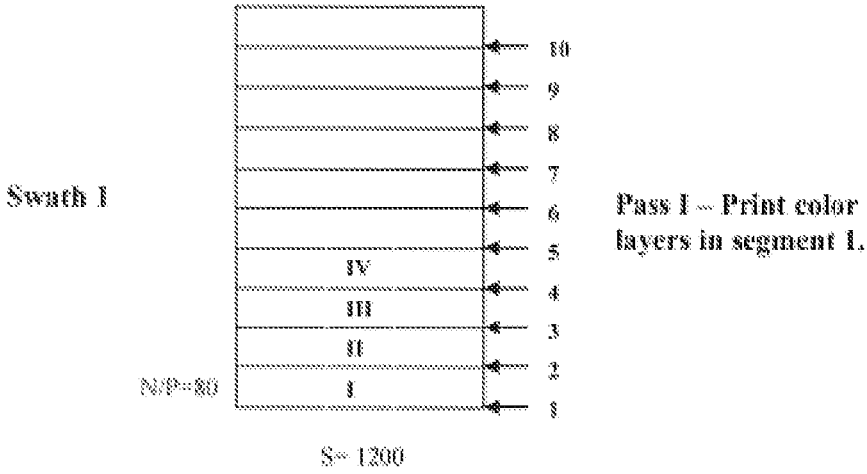
FIG. 4B illustrates color layer in segments before building a first swath, according to an exemplary embodiment of the present invention.
Figure 4C:
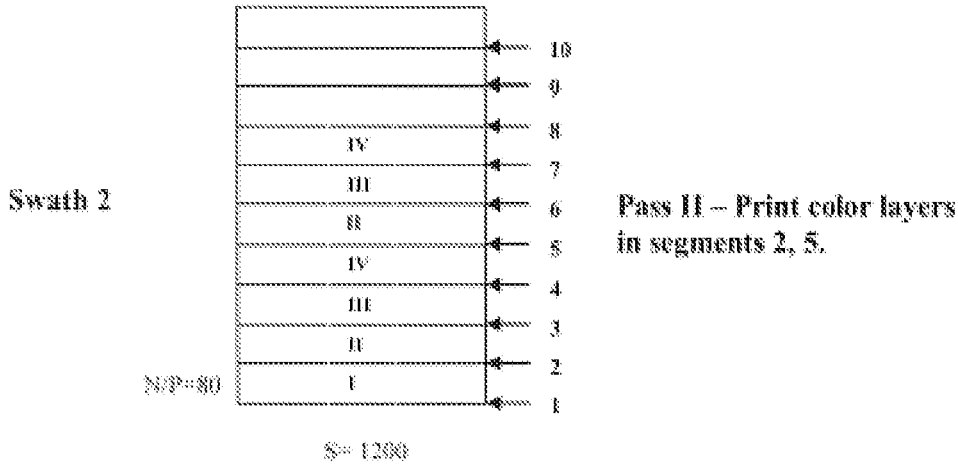
FIG. 4C illustrates the color layers in segments before building a second swath, according to an exemplary embodiment of the present invention.
Figure 4D:
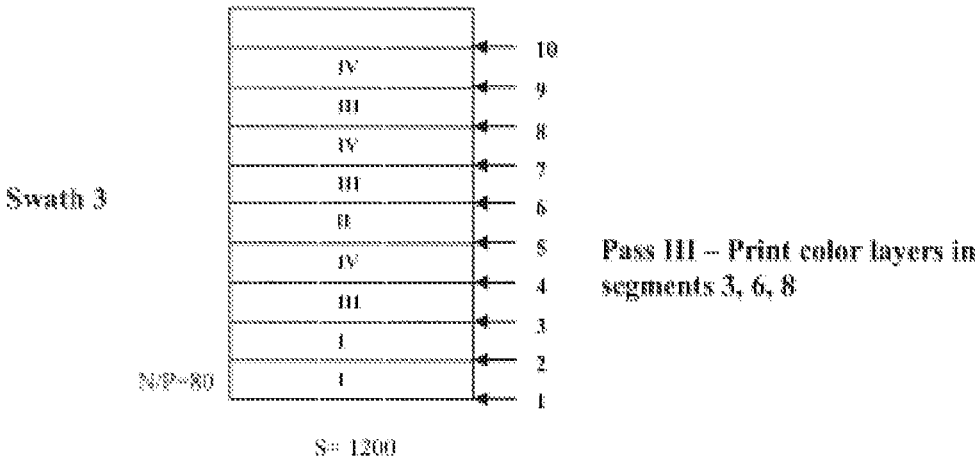
FIG. 4D illustrates the color layers in segments before building a third swath, according to an exemplary embodiment of the present invention.
Figure 4E:
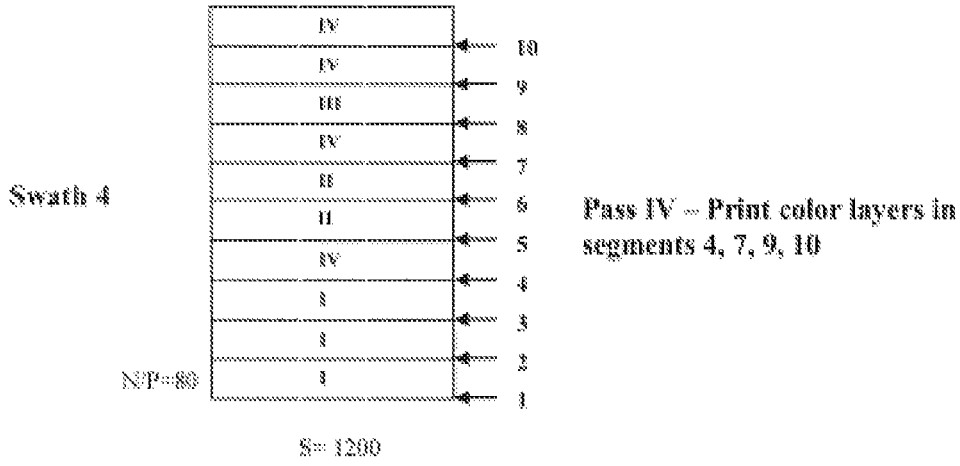
FIG. 4E illustrates the color layers in segments before building a fourth swath, according to an exemplary embodiment of the present invention.
Figure 4F:
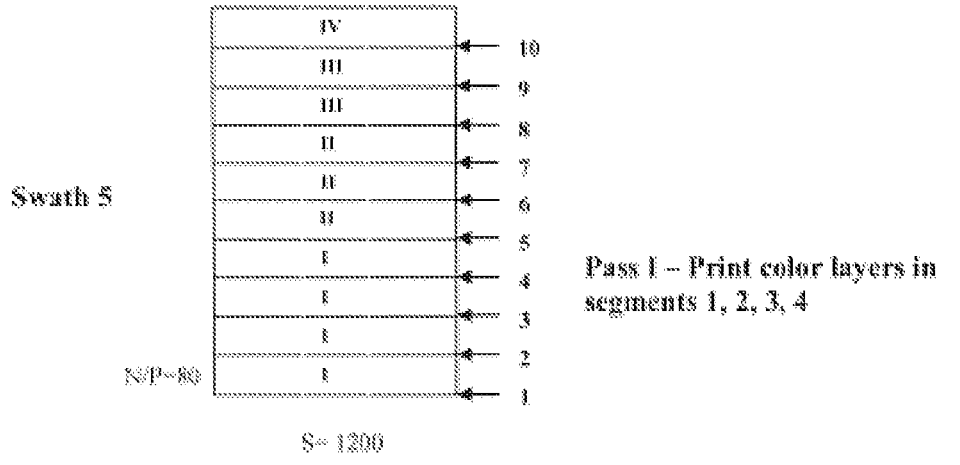
FIG. 4F illustrates the color layers in segments before building a fifth swath, according to an exemplary embodiment of the present invention.

Referring to FIG. 3, a flowchart illustrating a method 200 of printing swaths in an inkjet printer 20 with reduced memory usage for delay buffer 34 is shown. At block 202, after receiving the image data from the host computer 10, and prior to rearranging the image data into swath data, the formatter 23 determines minimum number of printing passes (P) using the equation: $P=(H_i*V_i)/(H_s*V_s)$, wherein $H_i$ equals horizontal resolution of the image data; $V_i$ equals vertical resolution of the swath data; $H_s$ equals horizontal resolution of the swath data; and $V_s$ equals vertical resolution of the swath data.

At block 204, the formatter 23 estimates the amount of memory ($M_1$) required to hold the swath data in the delay buffer 34. The memory ($M_1$) is calculated using the equation: $M_1=N*S*(P+1)/2$, wherein, N is the number of nozzles in a color bank of the printhead 28; S is the horizontal resolution of the swath; and P is the number of passes needed to advance the print media 32 for the full printhead size. After estimating the memory ($M_1$), the formatter 23 allocates the memory equal to a value of $M_1$ for the delay buffer 34. At block 206, the formatter 23 divides the delay buffer 34 into 'g' segments (SG) having a first segment ($SG_1$), a second segment ($SG_2$), a $(g-1)^{th}$ segment ($SG_{g-1}$) and a $g^{th}$ segment ($SG_g$), where g is the number of segments i.e. $g=P(P+1)/2$, such that, size of each segment $SG_1=(N/P)*S$, where i=1, 2, . . . g.

At block 208, the formatter 23 checks for incoming raster lines from the printer driver 14. If yes, at block 210, the formatter 23 receives (N/P)*D raster lines, wherein $D=V_i/V_s$. Subsequently, at a block 212, the formatter 23 splits the (N/P)*D raster lines into P color layers having a first color layer ($CL_1$) for a first pass, a second color layer $CL_2$ for a second pass, a $(P-1)^{th}$ color layer ($CL_{p-1}$) for a $(P-1)^{th}$ pass, and a $P^{th}$ color layer ($CL_P$) for a $P^{th}$ pass. At block 214, the formatter 23 searches for empty segments ($SG_g$) from g segments from bottom to top of the delay buffer 34, and groups the empty segments into a first empty segment ($SG_{g1}$), a second empty segment ($SG_{g2}$), a $(P-1)^{th}$ empty segment ($SG_{g(P-1)}$), and a $P^{th}$ empty segment ($SG_{gP}$), where $SG_g$ is a subset of SG. At block 216, the formatter 23 stores the color layers for pass 1 ($CL_1$) in $SG_{g1}$, color layers for pass 2 ($CL_2$) in $SG_{g2}$, color layers for pass 3 ($CL_3$) in $SG_{g3}$ and color layers for pass P($CL_P$) in $SG_{gp}$.

At block 218, the formatter 23 builds $i^{th}$ swath using segment having color layers for pass i($CL_i$), where i=1, 2, 3, P. At block 220, the formatter 23 empties the segment having the color layers for $i^{th}$ pass, such that, the empty segments are available for storing the color layers for reuse. At block 222, the print media 32 is advanced and the formatter 23 checks for further raster lines. Again, at block 208, if the formatter 23 determines that there are no further incoming raster lines, the formatter 23 finishes imaging the print media 32 at block 224.

In the method 200, when the delay buffer 34 is not full, the formatter 23 prints color layers stored in less than P segment for a pass, i.e., for the first (P−1) swaths, the full printhead size has not been in the printable area, and each swath is built with (N/P)*n color layers, where n=1, 2, 3, P−1. When the delay buffer 34 is full, and the full printhead size is in the printable area, the formatter 23 print color layers stored in all the P segments, i.e., each swath is built with (N/P)*P color layers (i.e. N color layers) in order to use the full printhead size. The formatter 23 thereby, always ensures that there are at least P segments available for storing the color layers. Now, comparing the memory space $M_1$($M_1$=N*S*(P+1)/2) allocated in method 200 and memory space M(M=N*S*P)), it may be inferred that (P+1)/2 is less than P, and $M_1$<M. As a result, the printing passes increase when the printing resolution gets higher, and in such cases, the value of $M_1$ gets closer to half of M, i.e., (P+1)/2=P/2.

Now, referring to FIGS. 4A-4F, the color layer in segments when swaths are built in accordance with the method 200 for printing resolution of 2400×1200 dpi is illustrated. Considering an image data of 2400×1200 dpi printing resolution is to be printed, and each color bank has 320 nozzles, the minimum number of passes is calculated from the equation: P=($H_i$*$V_i$)/($H_s$*$V_s$). Therefore, passes (P)=(2400*1200)/(1200*600)=4. The memory is calculated from the equation $M_1$=N*S*(P+1)/2. Therefore, memory ($M_1$)=320*1200*(4+1)/2=960,000, i.e. 960,000 bytes of memory is allocated to the delay buffer 34. Then, the allocated delay buffer 34 is divided into g segments, i.e., g=P(P+1)/2=10, such that, each segment has a size of $M_1$/g=960,000/10=96,000 bytes. Formatter 23 keeps a set of pointers for all the segments. Before a swath is printed, raster lines are broken into color lines, and the color lines are split into color layers. For the printhead 28 to print 4 passes, pass I prints ink dots on odd rows and odd columns, pass II prints ink dots on even rows and odd columns, pass III prints ink dots on odd rows and even columns, and pass IV prints ink dots on even rows and even columns (see FIG. 4A).

When a printing job is started, formatter 23 receives N/P*D raster lines, i.e., (320/4)*(1200/600),i.e., first 160 raster lines and splits them into 320 color layers for each color. Then, the formatter 23 look for empty segments from bottom to top, to store 320 color layers. The color layers for Pass I are stored in segment 1; color layers for Pass II are stored in Segment 2; color layers for Pass III are stored in Segment 3; and color layers for Pass IV are stored in Segment 4. As illustrated in FIGS. 4B-4F (and FIGS. 6A-6C), each segment shows can hold 80 color layers (N/P=80) each having a length of 1200 bytes (S=1200) for the printing mode of 2400×1200 dpi and 4 passes. Swath 1 is built with color layers in segment 1 for Pass I (See FIG. 4B). Formatted 23 stores next 320 color layers in segments. Segment 1 is now set as empty and available for reuse. Color layers for Pass I are stored in segment 1; color layers for Pass II are stored in segment 5; color layers for Pass III are stored in segment 6; color layers for Pass IV are stored in segment 7. Swath 2 is built with color layers for Pass II, i.e. color layers in segment 2 and segment 5 (See FIG. 4C). Formatter 23 stores the next 320 color layers in segments. Now, segment 2 and segment 5 are set as empty segments and available for reuse. Color layers for Pass I are stored in segment 2; color layers for Pass II are stored in segment 5; color layers for Pass III are stored in segment 8; color layers for Pass IV are stored in segment 9. Swath 3 is built with colors layers in segments 3, 6, 8 for Pass III (See FIG. 4D). Formatter 23 stores the next 320 color layers in segments. Now segments 3, 6, and 8 are set as empty, and available for reuse. Color layers for Pass I are stored in segment 3; color layers for Pass II are stored in segment 6; color layers for Pass III are stored in segment 8; color layers for Pass IV are stored in segment 10. All the segments are now filled with color layers. Swath 4 is built with color layers in segments 4, 7, 9, 10 for Pass IV (See FIG. 4E), Formatter 23 stores next 320 color layers in segments. Now segments 4, 7, 9, and 10 are set as empty. Color layers for Pass I are stored in segment 4; color layers for Pass II are stored in segment 7; color layers for Pass III are stored in segment 9; color layers for Pass IV are stored in segment 10. Swath 5 is built with color layers in segments 1, 2, 3, 4 for Pass I (See FIG. 4F). The above process of storing 320 color layers and building a new swath is repeated until the image data is printed. Since, the empty segments are reused after each swath is printed, 960,000 bytes ($M_1$) of memory space is enough for building the swath data, and printing the image.

The method 200 of allocating the memory space of $M_1$=N*S*(P+1)/2 (960,000 bytes for the illustrative example) uses 37% less memory than the method that implements a memory space of M=N*S*P(1,536,000 bytes). The percentage of memory saved by allocating of memory space of $M_1$=N*S*(P+1)/2 may be calculated by the equation: (P−1)/2P, wherein P is minimum number of passes. For example: if P is 4, then the amount of memory saved is 37%; if P is 8, then the amount of memory saved is 44%; and if P is 16, then the amount of memory saved is 47%. Therefore, as the printing resolution and in turn the printing passes increases, the percentage of memory saved by utilizing the method 200 also increases.

Figure 5:
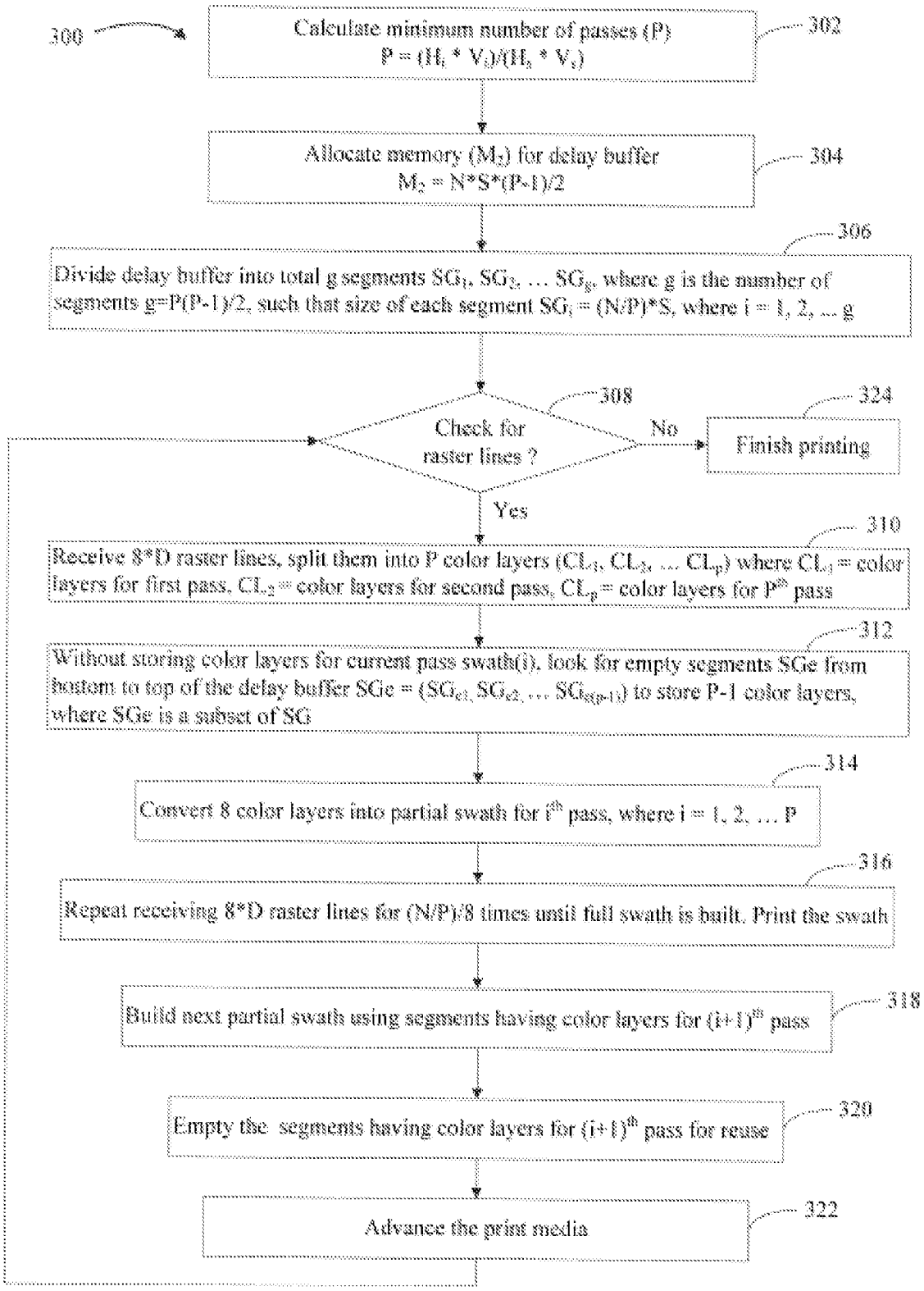
FIG. 5 is a flowchart illustrating another method for printing swaths with reduced memory usage for delay buffer, according to another exemplary embodiment of the present invention.

Now referring to FIG. 5, a flowchart illustrating a method 300 of printing swaths in an inkjet printer 20 with reduced memory usage for delay buffer 34 is shown. At block 302, after receiving the image data from the host computer 10, and prior to rearranging the image data into swath data, the formatter 23 determines the minimum number of printing passes (P) using the equation P=($H_i$*$V_i$)/($H_s$*$V_s$), wherein $H_i$ equals horizontal resolution of the data; $V_i$ equals vertical resolution of the image data; $H_s$ equals horizontal resolution of the swath data; and $V_s$ equals vertical resolution of the swath data.

At block 304, the formatter 23 estimates the amount of memory ($M_2$) required to hold the swath data in the delay buffer 34. The memory space ($M_2$) is calculated using the equation: $M_2$=N*S*(P−1)/2, wherein N is the number of nozzles in color bank, S is the horizontal resolution of the swath; and P is the number of passes needed to advance the print media 32 for the full printhead size. After estimating the memory ($M_2$), the formatter 23 allocates a memory equal to the value of $M_2$ for the delay buffer 34. At block 306, the formatter 23 divides the delay buffer 34 into 'g' segments having a first segment ($SG_1$), a second segment ($SG_2$), a $(g-1)^{th}$ segment ($SG_{g-1}$) and a $g^{th}$ segment ($SG_g$), where g is the number of segments i.e. g=P(P−1)/2, such that, size of each segment $SG_i$=(N/P)*S, where i=1, 2, . . . g.

At block 308, the formatter 23 checks for incoming raster lines from the printer driver 14. If the formatter 23 determines that there are incoming raster lines, then, at block 310, the formatter 23 receives 8*D raster lines, and split the 8*D raster lines into P color layers ($CL_1$,$CL_2$, . . . $CL_{P-1}$, $CL_P$), wherein $CL_1$ is a first color layer for a first pass, $CL_2$ is a second color layer for a second pass, $CL_{P-1}$ is a $(P-1)^{th}$ color layer for a $(P-1)^{th}$ pass P, $CL_P$ is a $P^{th}$ color layer for a $P^{th}$ pass. Then, at block 312, the formatter 23 searches for empty segments ($SG_g$) from g segments from bottom to top of the delay buffer 34, and groups the empty segment into a first empty segment ($SG_{g1}$), a second empty segment ($SG_{g2}$), and a $(P-1)^{th}$ empty segment ($SG_{g(P-1)}$), where $SG_g$ is a subset of SG, and subsequently stores P−1 color layers in the empty segment without storing the color layers for current pass, i.e., $i^{th}$ pass, where i=1, 2, 3 . . . P.

At block 314, the formatter 23 converts the 8 color layers into partial swath for the $i^{th}$ pass. At block 316, the formatter 23 repeats the process of receiving 8*D raster lines for (N/P)/8 times until a full swath is built. Subsequently, the formatter 23 prints the swath. At block 318, the formatter 23 builds a next partial swath using those segments having color layers for $(i+1)^{th}$ pass. At block 320, the formatter 23 empties the segments having color layers for $(i+1)^{th}$ pass for reuse. At block 322, the formatter 23 enables the feed roller unit 30 to advance the print media 32, and further, checks for incoming raster lines at block 308. At block 308, if the formatter 23 determines that there are no further incoming raster lines, the formatter 23 de-allocates the memory space, and finishes imaging the print media 32 at block 324.

In the method 300, when the delay buffer 34 is not full, the formatter 23 prints color layers stored in less than (P−1) segments for a pass, i.e., for the first (P−1) swaths the full printhead size has not been in the printable area each swath is built with (N/P)*n color layers, n=1, 2, 3, . . . P−1. When the delay buffer 34 is full, the formatter 23 prints color layers stored in all the P−1 segments, i.e., each swath is built with (N/P)*P color layers (N color layers) in order to use the full printhead size. The formatter 23 thereby ensures that there are at least (P−1) segments available for storing the color layers. Now, comparing the memory space $M_2$($M_2$=N*S*(P−1)/2) allocated in method 300 and memory space M(M=N*S*P), it may be inferred that (P−1)/2 is less than P, and $M_2$<M. As a result, the number of printing passes increases as the printing resolution gets higher, and in such cases, the value of $M_2$ gets closer to half of M, i.e., (P−1)/2≈P/2.

Figure 6A:
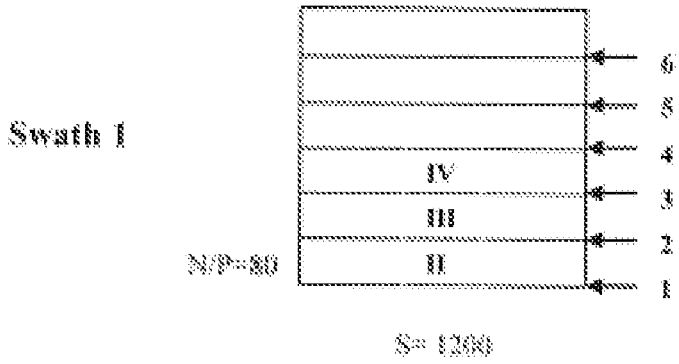
FIG. 6A illustrates the color layers in segments before building a first swath, according to another exemplary embodiment of the present invention.
Figure 6B:
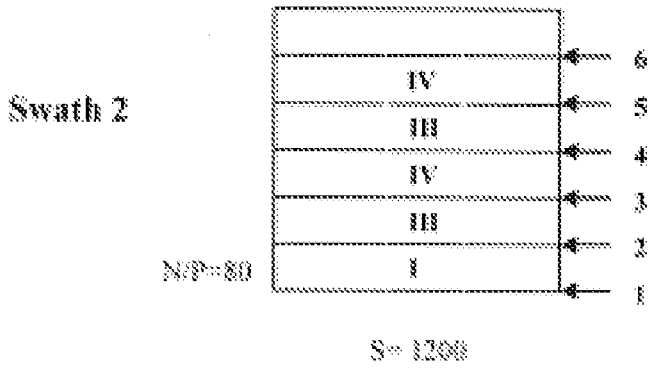
FIG. 6B illustrates the color layers in segments before building a second swath, according to another exemplary embodiment of the present invention.
Figure 6C:
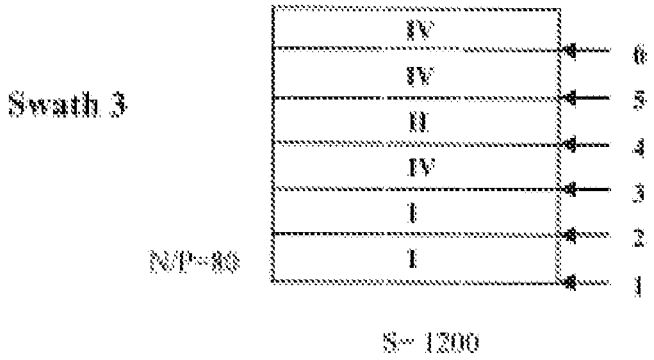
FIG. 6C illustrates the color layers in segments before building a third swath, according to another exemplary embodiment of the present invention.

FIGS. 6A-6C illustrates the color layers in segments when swath are built in accordance with the method 300 for a printing resolution of 2400×1200 dpi. Consider that an image data of 2400×1200 dpi printing resolution is to be printed, and each color bank has 320 nozzles, the minimum number of passes may be calculated from the equation: $P=(H_i*V_i)/(H_s*V_s)$. Therefore, pass (P)=(2400*1200)/(1200*600)=4. The memory pace may be calculated from the equation $M_2$=N*S*(P−1)/2. Therefore, memory ($M_2$)=320*1200*(4−1)/2=576,000 i.e. 576,000 bytes of memory is allocated to the delay buffer 34. Then, the allocated delay buffer 34 is divided into g segments, i.e. g=P(P−1)/2=6, such that, each segment has a size of $M_2$/g=576,000/6=96,000 bytes. Formatter 23 keeps a set of pointers for all the segments. Before a swath is printed, raster lines are broken into color lines, and the lines are spilt into color layers. For the printhead to print 4 passes, Pass I prints ink dots on odd rows and odd columns, Pass II prints ink dots on even rows and odd columns, Pass III prints ink dots on odd rows and even columns, and Pass IV prints ink dots on even rows and even columns (see FIG. 1A and FIG. 4A).

In the method 300, the formatter 23 converts color layers into a swath, and does not store the color layers to a segment for the current pass, and conversion of color layers to swath is performed whenever formatter 23 has received 8*D raster lines. Data in 8 color layers can be converted into whole number of bytes in swath data. The conversion of 8 color layers to swath will be repeated until a full swath is built. Color layers for other passes are stored in the segments.

When a printing job is started, formatter 23 receives 8*D raster lines and splits them into color layers. At this point in the process, color layers for current Pass I are not stored in a segment. Next, the color layers for Pass I are converted to a partial swath for Pass I. Color layers for other passes are stored in segments. Color layers for Pass II are stored in segment 1. Color layers for Pass III are stored in segment 2. Color layers for Pass IV are stored in segment 3 (see FIG. 6A). Each time, the method 300 converts 8 color layers to a swath. The conversion is carried out 10 times [(N/P)/8] before a full swath is built. Next, swath 1 is printed. Before receiving any new raster lines, formatter 23 builds a partial swath with all 80 color layers in segment 1 for Pass II. Formatter 23 receives next 8*D raster lines and breaks them into color layers. Color layers for current Pass II are not stored in a segment, and are directly converted to the partial swath. Color layers for other passes are stored in segments. At this point in the process, segment 1 is empty. Color layers for Pass I are stored in segment 1; color layers for Pass III are stored in segment 4; color layers for Pass IV are stored in segment 5 (see FIG. 6B). Formatter 23 processes 8*D raster lines each time until a full swath is built. Thereafter, Swath 2 is printed. Before receiving any new raster lines, formatter 23 builds a partial swath with all 160 color layers in segment 2 and segment 4 for Pass III. Formatter 23 receives the next 8*D raster lines and splits them into color layers. Color layers for current Pass III are not stored in a segment, and are directly converted to the partial swath. Color layers for other passes are stored in segments. Segment 2 and segment 4 are empty. Color layers for Pass I are stored in segment 2; color layers for Pass II are stored in segment 4; color layers for Pass IV are stored in segment 6 (see FIG. 6C). Formatter 23 repeats this process until a full swath is built. Then, Swath 3 is built. At this point, all the segments are used. Then, a fourth swath is built with color layers in segments 3, 5 and 6 for Pass IV including 80 more incoming color layers. The formatter 23 keeps track of empty segments throughout a printing job. Since the empty segments are reused after each swath is printed, 576,000 bytes ($M_2$) of memory space is enough for building the swath data, and printing the image.

The method 300 of allocating the memory space of $M_2$=N*S*(P−1)/2 (576,000 bytes) uses 63% less memory than the method that implements a memory space of M=N*S*P(1,536,000 bytes). The percentage of memory saved by allocating a memory space of $M_2$=N*S*(P−1)/2 can be calculated by the equation: (P+1)/2P, wherein P is the minimum number of passes. For example: if P is 4, then the amount of memory saved is 63%; if P is 8, then the amount of memory saved is 56%; and if P is 16, then the amount of memory saved is 53%.

The foregoing description of several methods and embodiments of the present disclosure have been presented for purposes of illustration. It is not intended to be exhaustive or to limit present disclosure to the precise steps and/or forms disclosed, and obviously many modifications and variations are possible in light of the above teaching. It is intended that the scope of the present disclosure be defined by the claims appended hereto.

What is claimed is:

1. A method of printing swath of an image, comprising:

(a) calculating, a minimum number of passes P required to print the image using the equation $P=(H_i*V_i)/(H_s*V_s)$, wherein $H_i$ equals horizontal resolution of the image, $V_i$ equals vertical resolution of the image, $H_s$ equals horizontal resolution of the swath, and $V_s$ equals vertical resolution of the swath;

(b) allocating a memory space equal to N*S*(P+1)/2 for a delay buffer, wherein N equals number of nozzles in a color bank and S equals horizontal swath resolution;

(c) dividing the delay buffer into g segments having a first segment, a second segment, a $(g-1)^{th}$ segment, and a $g^{th}$ segment, wherein g=P(P+1)/2, such that, size of each of g segment equals (N/P)*S;

(d) receiving (N/P)*D raster lines splitting the raster lines into P color layers having a first color layer for a first pass, a second color layer for a second pass, a $(P-1)^{th}$ color layer for a $(P-1)^{th}$ pass, and a $P^{th}$ color layer for a $P^{th}$ pass, wherein D equals $V_i/V_s$;

(e) searching for empty segments from g segments of the delay and grouping the empty segment into a first empty segment, a second empty segment, a $(P-1)^{th}$ empty segment and a $P^{th}$ empty segment;

(f) storing the first color layer for the first pass in the first segment, the second color layer for the second pass in the second empty segment, the $(P-1)^{th}$ color layer for the $(P-1)^{th}$ pass in $(P-1)^{th}$ empty segment, and the $P^{th}$ color layer for the $P^{th}$ pass in the $P^{th}$ empty segment;

(g) building an $i^{th}$ swath using segments having color layers for $i^{th}$ pass, and printing the $i^{th}$ swath, wherein, i equals 1, 2, P;

(h) emptying the segment having the color layer for the $i^{th}$ pass;

(i) advancing the print media and checking for incoming raster lines; and (j) repeating steps (d) to (i) upon determining the incoming raster lines.

2. The method of claim 1, wherein the empty segments are a subset of g segments available for reuse to store the layers.

3. The method of claim 1, wherein the color layers for a printing pass are stored in less than P segment when the delay buffer is not full.

4. The method of claim 1, wherein the color layers for a printing pass are stored in P segments when the delay buffer is full.

5. The method of claim 1, wherein each time at least P segments of the delay buffer are available for storing the color layers.

6. A method of printing swaths of an image, comprising:

(a) calculating, a minimum number of passes P required to print the image using the equation $P=(H_i*V_i)/(H_s*V_s)$, wherein, $H_i$ equals horizontal resolution of the image, $V_i$ equals vertical resolution of the image, $H_s$ equals horizontal resolution of the swath, and $V_s$ equals vertical resolution of the swath;

(b) allocating a memory space equal to N*S*(P−1)/2 for a delay buffer, wherein N equals number of nozzles in a color bank and S equals horizontal swath resolution;

(c) dividing the delay buffer into g segments having a first segment, a second segment, a $(g-1)^{th}$ segment, and a $g^{th}$ segment, wherein g=P(P−1)/2, such that, size of each of g segment equals (N/P)*S;

(d) receiving incoming raster lines and splitting the raster lines into P color layers having a first color for a first pass, a second color layer for a second pass, a $(P-1)^{th}$ color layer for a $(P-1)^{th}$ pass, and a $P^{th}$ color layer for a $P^{th}$ pass;

(e) searching for empty segment from g segments of the delay buffer and grouping the empty segments into a first empty segment, a second empty segment, and a $(P-1)^{th}$ empty segment, and storing P−1 color layers in the empty segments without storing the color layers for $i^{th}$ pass, wherein i equals 1, 2, P;

(f) converting the $i^{th}$ color layers of the incoming raster lines into partial swath for the $i^{th}$ pass;

(g) repeating steps (d), (e) and (f) for (N/P)/8 times until a full swath is built for the $i^{th}$ pass, and printing the full swath;

(h) building a next partial swath using segments having color layers for $(i+1)^{th}$ pass;

(i) emptying the segments having the color layers for the $(i+1)^{th}$ pass;

(j) advancing a print media and checking for incoming raster lines; and (k) repeating steps (d) to (j) upon determining the incoming raster lines.

7. The method of claim 6, wherein each time 8*D raster lines are processed from the incoming raster lines prior to splitting the incoming raster lines into P color layers, where D equals $V_i/V_s$.

8. The method of claim 6, wherein each time 8 color layers are converted into partial swath for the $i^{th}$ pass.

9. The method of claim 6, wherein the empty segments are a subset of g segment from bottom to top the delay buffer available for reuse to store the color layers.

10. The method of claim 6, wherein the color layers for a printing pass are stored in less than P−1 segments when the delay buffer is not full.

11. The method of claim 6, wherein the color layers for a printing pass are stored in P−1 segments when the delay buffer is full.

12. The method of claim 6, wherein each time at least (P−1) segments of the delay buffer are available for storing the color layers.

13. An inkjet printer, comprising:

a printhead having a plurality of nozzles arranged in at least one vertical column, wherein the nozzle is capable of selectively ejecting droplets of ink on a print media to form swath of an image;

a printhead carrier capable of mounting and carrying the printhead;

a carrier drive unit enabling the movement of the printhead carrier across the print media;

a feed roller unit capable of advancing the print media during imaging; and a controller communicatively coupled to the printhead, the printhead carrier, the carrier drive unit and the feed roller unit, the controller having programmable instruction for performing a method, comprising;

(a) calculating a minimum number of passes P required to print the image using the equation $P=(H_i*V_i)/(H_s*V_s)$, wherein, $H_i$ equals horizontal resolution of the image, $V_i$ equals vertical resolution of the image, $H_s$ equals horizontal resolution of the swath, and $V_s$ equals vertical resolution of the swath;

(b) allocating a memory space equal to N*S*(P+1)/2 for a delay buffer, wherein N equals number of nozzles in a color bank and S equals horizontal swath resolution;

(c) dividing the delay buffer into g segment a first segment, a second segment, a $(g-1)^{th}$ segment, and a $g^{th}$ segment, wherein g=P(P+1)/2, such that, size of each of g segment equals (N/P)*S;

(d) receiving (N/P)*D raster lines and splitting the raster lines into P color layers having a first color layer for a first pass, a second color layer for a second pass, a $(P-1)^{th}$ color layer for a $(P-1)^{th}$ pass, and a $P^{th}$ color layer for a $P^{th}$ pass, wherein D equals $V_i/V_s$;

(e) searching for empty segments from g segments of the delay and grouping the empty segment into a first empty segment, a second empty segment, a $(P-1)^{th}$ empty segment, and a $P^{th}$ empty segment;

(f) storing the first color layer for the first pass in the first segment, the second color layer for the second pass in the second empty segment, the $(P-1)^{th}$ color layer for the $(P-1)^{th}$ pass in $(P-1)^{th}$ empty segment, and the $P^{th}$ color layer for the $P^{th}$ pass in the $P^{th}$ empty segment;

(g) building an $i^{th}$ swath using segments having color layers for $i^{th}$ pass, and printing the $i^{th}$ swath, wherein, i equals 1, 2, P;

(h) emptying the segment having the color layers for the $i^{th}$ pass;

(i) advancing the print media and checking for incoming raster lines; and (j) repeating steps (d) to (i) upon determining the incoming raster lines.

14. The inkjet of claim 13, wherein the inkjet printer is communicatively coupled to a host computer with a memory having printing driver capable of sending an image data of the image in the form of consecutive raster lines to the controller.

15. The inkjet printer of claim 14, wherein the controller comprises a formatter capable of generating a swath data based on the image data transferred from the host computer.

16. The inkjet printer of claim 13, wherein the nozzles are capable of depositing dots of cyan, magenta, and yellow ink in a combination such that at least black color, blue color, red color, green color, magenta color, cyan color, yellow color, and white color are produced.

17. An inkjet printer, comprising:

A printhead having a plurality of nozzles arranged in at least one vertical column, wherein the nozzle is capable of selectively ejecting droplets of ink on a print media to form swath of an image;

a printhead carrier capable of mounting and carrying the printhead;

a carrier drive unit enabling the movement of the printhead carrier the print media;

a feed roller unit capable of advancing the print media during imaging; and a controller communicatively coupled to the printhead, the printhead carrier, the carrier drive unit and the feed roller unit, the controller having programmable instructions for performing a method, comprising:

(a) calculating, a minimum number of passes P required to print the image using the equation $P=(H_i*V_i)/(H_s*V_s)$, wherein, $H_i$ equals horizontal resolution of the image, $V_i$ equals vertical resolution of the image, $H_s$ equals horizontal resolution of the swath, and $V_s$ equals vertical resolution of the swath;

(b) allocating a memory space equal to N*S*(P−1)/2 for a delay buffer, wherein N equals number of nozzles in a color bank and S equals horizontal swath resolution;

(c) dividing the delay buffer into g segments having a first segment, a second segment, a $(g-1)^{th}$ segment, and a $g^{th}$ segment, wherein g=P(P−1)/2, such that, size of each of g segment equals (N/P)*S;

(d) receiving incoming raster lines and splitting the raster lines into P color layers having s first color layer for a first pass, a second color layer for a second pass, a $(P-1)^{th}$ color layer for a $(P-1)^{th}$ pass, and a $P^{th}$ color layer for $P^{th}$ pass;

(e) searching for empty segments from g segments of delay buffer and grouping the empty segment into a first empty segment, a second empty segment, and a $(P-1)^{th}$ empty segment, and storing P−1 color layers in the empty segments without storing the color layers for $i^{th}$ pass, wherein i equals 1, 2, P;

(f) converting the $i^{th}$ color layers of the incoming raster lines into partial swath for the $i^{th}$ pass;

(g) repeating steps (d), (e) and (f) for (N/P)/8 times until a full swath is built for the $i^{th}$ pass, and printing the full swath;

(h) building a next partial swath using segments having color layers for $(i+1)^{th}$ pass;

(i) emptying the segments having the color layers for the $(i+1)^{th}$ pass;

(j) advancing a print media and checking for incoming raster line; and (k) repeating steps (d) to (j) upon determining the incoming raster lines.

18. The inkjet printer of claim 17, wherein the inkjet printer is communicatively coupled to a host computer with a memory having printer driver capable of sanding an image data of the image in the form of consecutive raster lines to the controller.

19. The inkjet printer of claim 18, wherein the controller comprises a formatter capable of generating a swath data based on the image data transferred from the host computer.

20. The inkjet of claim 17, wherein the nozzles are capable of depositing dots of cyan, magenta, and yellow ink in a combination such that at least black color, blue color, red color, green color, magenta color, cyan color, yellow color, and white color are produced.

* * * * *